US005787321A

United States Patent [19]

Nishikawa et al.

[11] Patent Number: 5,787,321

[45] Date of Patent: Jul. 28, 1998

[54] TEMPERATURE CONTROLLING DEVICE FOR FIXING UNIT

[75] Inventors: Tomoyuki Nishikawa; Tsukasa Yanashima, both of Tokyo, Japan

[73] Assignee: Asahi Kogaku Kogyo Kabushiki Kaisha, Tokyo, Japan

[21] Appl. No.: 795,688

[22] Filed: Feb. 4, 1997

[30] Foreign Application Priority Data

Feb. 9, 1996 [JP] Japan ..... 8-023975

[51] Int. Cl.[6] ..... G03G 15/20

[52] U.S. Cl. ..... 399/69; 165/205; 165/247; 165/294; 399/92

[58] Field of Search ..... 399/67, 69, 92, 399/334, 94; 165/205, 244, 247, 288, 294; 219/216

[56] References Cited

U.S. PATENT DOCUMENTS

| | | | |
|---|---|---|---|
| Re. 31,891 | 5/1985 | Tickner et al. | 355/75 |
| 3,884,623 | 5/1975 | Slack . | |
| 4,154,521 | 5/1979 | Tanaka | 399/93 |
| 4,202,618 | 5/1980 | Waschk et al. | 399/93 |
| 4,264,190 | 4/1981 | Tsuda et al. | 399/123 |
| 4,365,139 | 12/1982 | Dannatt | 219/216 |
| 4,585,325 | 4/1986 | Euler | 399/69 |
| 4,594,068 | 6/1986 | Bardutzky et al. | 432/60 |
| 4,595,274 | 6/1986 | Sakurai | 399/331 |
| 4,618,240 | 10/1986 | Sakurai et al. | 219/216 |
| 4,693,588 | 9/1987 | Yarbrough et al. | 399/93 |
| 4,801,968 | 1/1989 | Kogure et al. | 399/334 |
| 4,825,242 | 4/1989 | Elter | 399/67 |
| 4,897,675 | 1/1990 | Negishi | 347/133 |
| 5,028,959 | 7/1991 | Gooray | 399/93 |
| 5,038,170 | 8/1991 | Serita | 399/92 |
| 5,038,174 | 8/1991 | Kato et a. | 399/92 |
| 5,041,718 | 8/1991 | D'Hondt et al. | 219/255 |
| 5,053,806 | 10/1991 | Haigo et al. | 355/401 |
| 5,063,416 | 11/1991 | Honda et al. | 399/384 |
| 5,070,231 | 12/1991 | Bacus et al. | 219/216 |
| 5,073,796 | 12/1991 | Suzuki et al. | 399/93 |
| 5,132,731 | 7/1992 | Oda | 399/92 |
| 5,155,539 | 10/1992 | Yamaguchi et al. | 399/317 |
| 5,223,901 | 6/1993 | Endo et al. | 399/334 |
| 5,307,132 | 4/1994 | Tsuchiya | 399/70 |
| 5,325,158 | 6/1994 | Guelfo et al. | 399/92 |
| 5,355,203 | 10/1994 | Nishikawa et al. | 399/334 |
| 5,432,593 | 7/1995 | Nishikawa et al. | 399/328 |
| 5,475,481 | 12/1995 | Nishikawa et al. | 399/297 |
| 5,479,242 | 12/1995 | Sato et al. | 399/92 |
| 5,549,401 | 8/1996 | Ishikawa et al. | 400/618 |
| 5,550,621 | 8/1996 | Ogawahara | 399/69 |
| 5,557,388 | 9/1996 | Creutzmann et al. | 399/92 |
| 5,561,512 | 10/1996 | Fukano et al. | 399/69 |

FOREIGN PATENT DOCUMENTS

| | | |
|---|---|---|
| 4034499 | 5/1991 | Germany . |
| 61-254972 | 11/1986 | Japan . |
| 62-81682 | 4/1987 | Japan . |
| 62-123484 | 6/1987 | Japan . |
| 2103076 | 4/1990 | Japan . |
| 3-69980 | 3/1991 | Japan . |
| 4-096077 | 3/1992 | Japan . |
| 5-107983 | 4/1993 | Japan . |
| 6-019346 | 1/1994 | Japan . |

*Primary Examiner*—Arthur T. Grimley
*Assistant Examiner*—Sophia S. Chen
*Attorney, Agent, or Firm*—Greenblum & Bernstein, P.L.C.

[57] ABSTRACT

A temperature controlling device for an electrophotographic imaging device which has a fixing unit including a heat roller, the fixing unit performing a fixing operation in which toner is fixed on a recording sheet. The temperature controlling device includes a temperature sensing system, arranged about an outer surface of the heat roller such that, for the purpose of temperature measurement, the heat roller is divided into a plurality of areas along a rotational axis of the heat roller, and a temperature of each area is detected by the temperature sensing system; an air blowing system which blows air to each of the plurality of areas separately; and a controller which controls the air blowing system to blow air in accordance with temperatures of the plurality of areas in order to prevent overheating of any portions of the heat roller.

21 Claims, 10 Drawing Sheets

TEMPERATURE CONTROLLING DEVICE FOR FIXING UNIT

BACKGROUND OF THE INVENTION

The present invention relates to a temperature control device for a fixing unit of an electrophotographic printer.

The electrophotographic imaging process is a process where a photoconductive surface of a drum (i.e., a photoconductive drum) is evenly charged at a charging unit, the evenly charged photoconductive surface is exposed to light which is modulated in accordance with image data and a latent image is formed thereon. Then, an image is developed by applying toner onto the latent image at a developing unit, and the developed toner image is transferred onto a recording sheet at a transferring unit. The recording sheet bearing the transferred unfixed toner image is fed to a fixing unit which is provided with a heat roller and a press roller. As the recording sheet passes through a nip between the heat roller and the press roller, the toner image is fused and fixed onto the recording sheet.

Recently, electrophotographic printers have been required to be able to use recording sheets having various widths depending on the purpose of imaging. If the width of the recording sheet is considerably smaller than the width of the heat roller and the press roller, a problem may occur.

In this case, heat generated by the heat roller is absorbed by the recording sheet when it passes through the nip between the fixing roller and the press roller. If the sheet width is considerably smaller than the width of the heat roller and the press roller, a portion of the heat roller and the press roller through which the recording sheet does not pass may have a higher temperature than a portion of the rollers through which the recording sheet passes. If the temperature of a portion of the fixing roller and the press roller becomes too high, members provided around the heat roller as well as the fixing unit itself may be adversely affected. Further, in such a case, the temperature of the outer surface of the printer may also become high. Such a phenomenon should be avoided.

In order to avoid the problem indicated above, a method generally taken is that the temperature of the fixing roller is detected, and a heat source (such as a halogen lamp) is turned OFF so that the temperature of a portion of the heat roller is prevented from rising beyond an allowable level.

After the fixing roller is cooled sufficiently, the halogen lamp is turned ON again. The problem in this method is that once the halogen lamp is turned OFF, it will take time to bring the temperature of the fixing roller to a predetermined operable temperature after the halogen lamp is turned ON again, and until the temperature rises sufficiently, the printing operation cannot be carried out.

Summary of the Invention

It is therefore an object of the present invention to provide an improved temperature controlling device which is capable of preventing the temperature of a portion of a heat roller from raising above a predetermined level.

According to an aspect of the invention, there is provided a temperature controlling device for an electrophotographic imaging device which has a fixing unit including a heat roller, the fixing unit performing a fixing operation in which toner is fixed on a recording sheet. The temperature controlling device includes a temperature sensing system, arranged about an outer surface of the heat roller such that, for the purpose of temperature measurement, the heat roller is divided into a plurality of areas along a rotational axis of the heat roller, and a temperature of each area is detected by the temperature sensing system; an air blowing system which blows air to each of the plurality of areas separately; and a controller which controls the air blowing system to blow air in accordance with temperatures of the plurality of areas.

The temperature sensing system may, for example, include a plurality of temperature sensors that respectively detect temperatures of the plurality of areas.

In a particular case, the plurality of areas may include at least one first area which contributes to the fixing operation, and at least one second area which does not contribute to the fixing operation, and wherein the controller controls the air blowing system to blow air only to the second area.

In this particular case, the controller controls the air blowing system to increase an amount of air to be blown to the second area when a temperature of the second area exceeds a first predetermined value. Conversely, the controller may also control the air blowing system to decrease an amount of air to be blown to the second area when a temperature of the second area is less than a second predetermined value.

Alternatively, the controller may control the air blowing system to increase an amount of air to be blown to the second area when a temperature of the second area is greater than temperature of the first area by a predetermined amount. Also conversely, the controller controls the air blowing system to decrease an amount of air to be blown to the second area when a temperature of the second area is lower than a temperature of the first area by a predetermined amount.

In a further particular case, the air blowing system may include a plurality of fans for respectively blowing air to the plurality of areas, and wherein the controller controls the plurality of fans separately.

In this case, the controller may control fans corresponding to the second area to increase or decrease a revolution speed of the fans corresponding to the second area when a temperature of the second area exceeds a first predetermined value or is less than a second predetermined value, respectively.

Alternatively, the controller may control fans corresponding to the second area to increase or decrease a revolution speed of the fans corresponding to the second area when a temperature of the second area is greater than a temperature of the first area by a predetermined amount or is lower than a temperature of the first area by a predetermined amount, respectively.

In yet a further particular case, the air blowing system may include at least one fan and a plurality of partition members defining a plurality of ducts, wherein a configuration of the partition members is changeable so that air is introduced to selected ducts directed to selected areas selected from among the plurality of areas.

In this case, the temperature controlling device may further include a mechanism for changing the configuration of the plurality of partition members, wherein the controller drives the changing mechanism in accordance with a temperature of each area detected by the temperature sensing system.

In particular, the partition members may include a plurality of plate members, an outermost two of the plurality of plate members being fixed at predetermined positions, inner plates of the plurality of plate members being movable to form the plurality of ducts.

In a further particular case, the fixing unit may further including a press roller, the press roller positioned to form a nip between the heat roller and the press roller, the press roller being divided, for the purposes of temperature measurement, into a plurality of areas, and the temperature controlling device further including a second air blowing system which blows air to the plurality of areas of the press roller, wherein the controller drives the second air blowing system to blow air to the plurality of areas of the press roller selectively in accordance with temperatures of the plurality of areas of the heat roller.

In a further particular case, the plurality of areas may include at least one reference area, wherein the controller controls the air blowing system such that a temperature difference between the reference area and each other area of the plurality of areas is within a predetermined temperature range.

According to a second aspect, a temperature controlling device for an electrophotographic imaging device which has a fixing unit including a heat roller, may include a temperature distribution detecting system, which detects a temperature distribution of the heat roller in a direction parallel to a rotational axis of the heat roller; an air blowing system which blows air to any one of a plurality of predetermined areas of the heat roller, the plurality of predetermined areas being arranged along the rotational axis of the heat roller; and a controller which drives the air blowing system such that the temperature distribution stays substantially even.

According to yet another aspect, a temperature controlling device for an electrophotographic imaging device which has a fixing unit including a heat roller, may include a temperature distribution controlling system, which controls a temperature distribution of the heat roller in a direction parallel to a rotational axis of the heat roller such that a temperature differential between predetermined portions of the heat roller is within a first predetermined temperature range; and a temperature level controlling system, which controls a reference temperature of the heat roller to be in a second predetermined temperature range.

DETAILED DESCRIPTION OF THE PREFERRED EMBODIMENTS

Figure 1:
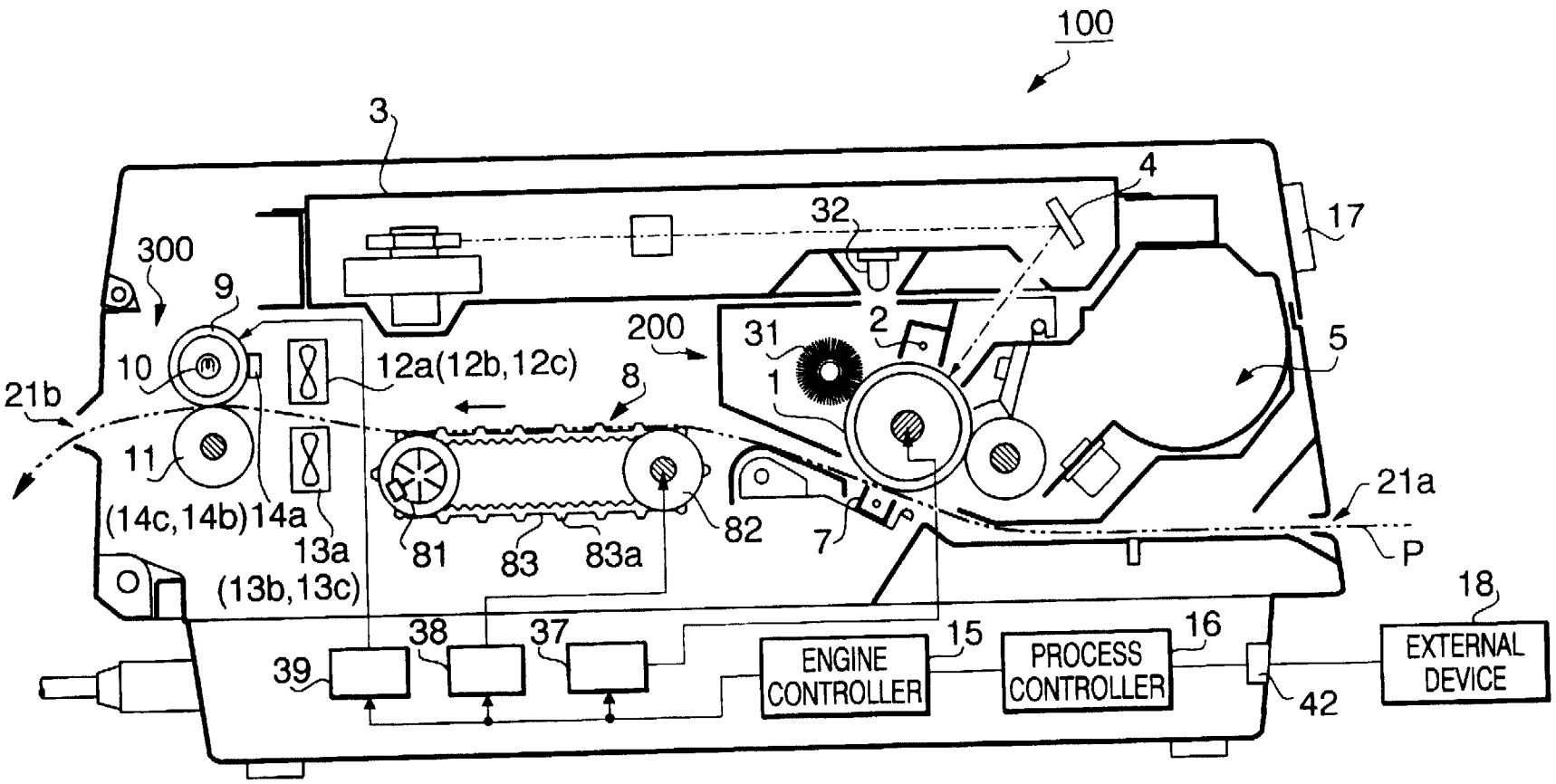
FIG. 1 shows a schematic side view of an electrophotographic printer, including a temperature controlling device according to a first embodiment of the invention.

FIG. 1 is a schematic side view showing an electrophotographic printer, in this case, a laser beam printer 100, which utilizes a temperature control device for a fixing unit according to a first embodiment of the invention.

The laser beam printer 100 receives image data from an external device 18, such as a personal computer or the like, and forms an image on a recording sheet P in accordance with an electrophotographic imaging process. In the embodiments, the recording sheet P to be loaded in the printer 100 is a continuous form (i.e., a fan-fold sheet).

The electrophotographic process is carried out by a process unit 200. The process unit 200 is provided with a photoconductive drum 1, and arranged around the photoconductive drum 1, in a clock-wise direction in the view of FIG. 1, a charging unit 2, a developing unit 5, a transfer unit 7, a cleaning brush 31, and a discharging lamp 32. Above the process unit 200, a laser scanning unit 3 is provided. In the laser scanning unit 3, a scanning laser beam is reflected by a mirror 4 such that the scanning laser beam passes out of the laser scanning unit 3 and is incident on the photoconductive drum 1.

The circumferential surface of the photoconductive drum 1 is formed of a photoconductive material. The photoconductive material is evenly charged by the charging unit 2, then exposed to the scanning laser beam which is modulated in accordance with image data to form a latent image on the photoconductive drum 1. The latent image is developed as a toner image at the developing unit 5, that is, toner is adhered onto the latent image. The toner image is then transferred onto the recording sheet P at a transferring unit 7. The recording sheet P is fed to the fixing unit 300. The fixing unit 300 includes a heat roller 9 and a press roller 11. As the recording sheet P passes through the nip between the heat roller 9 and the press roller 11, the toner image is fixed onto the recording sheet P.

Residual toner on the circumferential surface (i.e., the photoconductive surface) of the photoconductive drum 1 is removed by the cleaning brush 31, and further, any remaining charge on the photoconductive surface of the photoconductive drum 1 is discharged by the discharging lamp 32 in preparation for a successive imaging process.

In this embodiment, the recording sheet P includes feeding holes along both lateral sides of the recording sheet P, and perforations for separating discrete pages of the recording sheet P. The recording sheet P (shown by a double-dotted phantom line in FIG. 1) is fed along a predetermined feeding path between a sheet inlet 21*a* and a sheet outlet 21*b*.

The laser beam printer 100 further includes a tractor unit 8, for feeding the recording sheet P between the process unit 200 and the fixing unit 300, and first, second and third upper fans 12*a* through 12*c* and a first, second and third lower fans 13*a* through 13*c* for cooling the heat roller 9 and the press roller 10

The feeding path from the inlet 21*a* to the outlet 21*b* is arranged such that the recording sheet P passes the transfer station 7, is fed by the tractor unit 8, passes through a space between the first, second and third upper fans 12*a* through 12*c* and the first, second and third lower fans 13*a* through 13*c*, and then passes between the heat roller 9 and the press roller 11, at which point the toner image is fixed to the recording sheet P.

The photoconductive drum 1 is driven at a constant speed via a driving mechanism 37.

The tractor unit 8 is provided, corresponding to each lateral side of the recording sheet P, with a front pulley 81, a drive pulley 82, and an endless tractor belt 83 (having tractor pins 83*a* for engaging the feeding holes of the recording sheet P). The drive pulley 82 is driven by a driving mechanism 38. The driving mechanism 38 is controlled by the engine controller 15 to drive the tractor 8 at a constant speed which is substantially the same as the surface speed of the photoconductive drum 1.

In order to provide for the loading of any one of a plurality of types of the recording sheet, the belt 83 together with the pulleys 81 and 82 on at least one lateral side are made shiftable in the direction of the width of the recording sheet P. Accordingly, the distance between the tractor belts 83 can be adjusted to be the same as the width of the recording sheet P that is loaded.

Generally, among printers allowing the use of a plurality of kinds of recording sheet having different widths, there are three sheet adjustment types: a left-side registration type; a center registration type; and a right-side registration type.

The left-side registration type is a type such that the left side, when viewed from the top-right in FIG. 1, of the recording sheet P is located at a predetermined position inside the printer regardless of the width of the recording sheet P. In this type, therefore, the tractor belt 83 and the pulleys 81 and 82 corresponding to the other side (i.e., the right-hand side) of the recording sheet P are shifted so that the distance between the tractor belts 83 and 83 is the same as the width of the recording sheet P and the pins 83*a* of the tractor belts 83 and 83 fit in the feed holes on the sides of the recording sheet P.

The center registration type is a type such that the center, in the width direction, of the recording sheet P is always located at a predetermined position regardless of the width of the recording sheet P. In this type, therefore, the tractor belt 83 and the pulleys 81 and 82 corresponding to each side of the recording sheet P are shifted by the same amount so that the pins 83*a* fit in the feed holes.

The right-side registration type is a type such that the right side, when viewed from the top right in FIG. 1, of the recording sheet P is positioned at a predetermined position regardless of the width of the recording sheet P. In this type, therefore, the tractor belt 83 and the pulleys 81 and 82 corresponding to the other side (i.e., the left side) of the recording sheet P is shifted so that the pins 83*a* fit in the feed holes.

It should be noted that, generally, in a particular printer, only one of the above three types of registration is employed. The sheet registration type may be input through the operation unit 17. Alternatively, the sheet registration type can be stored as an operational parameter in a memory such as a ROM (Read only Memory) or the like.

The recording sheet P is fed through the nip between the heat roller 9 and the press roller 11. The heat roller 9 is driven by a driving mechanism 39. The heat roller 9 encloses a halogen lamp 10 which extends along a rotational axis of the heat roller 9 and which serves as a heat source for the heat roller 9. The heat roller 9 is driven to rotate such that the surface speed thereof is substantially the same as the surface speed of the photoconductive drum 1.

In the laser printer 100, first, second and third temperature sensors 14*a*, 14*b* and 14*c* are provided closely adjacent to the outer surface of the heat roller 9, on the right-hand side thereof in the view of FIG. 1. The first, second and third sensors 14*a* through 14*c* are arranged along a line parallel to the rotational axis of the heat roller 9, spaced substantially evenly apart.

The first, second and third upper fans 12*a* through 12*c*, and the first, second and third lower fans 13*a* through 13*c* are provided on the right-hand side of the heat roller 9 and the press roller 11, respectively (in the view of FIG. 1). The upper fans 12*a* through 12*c* are arranged along a line parallel to the rotational axis of the heat roller 9. The lower fans 13*a* through 13*c* are arranged along a line parallel to the rotational axis of the press roller 11.

Figure 2:
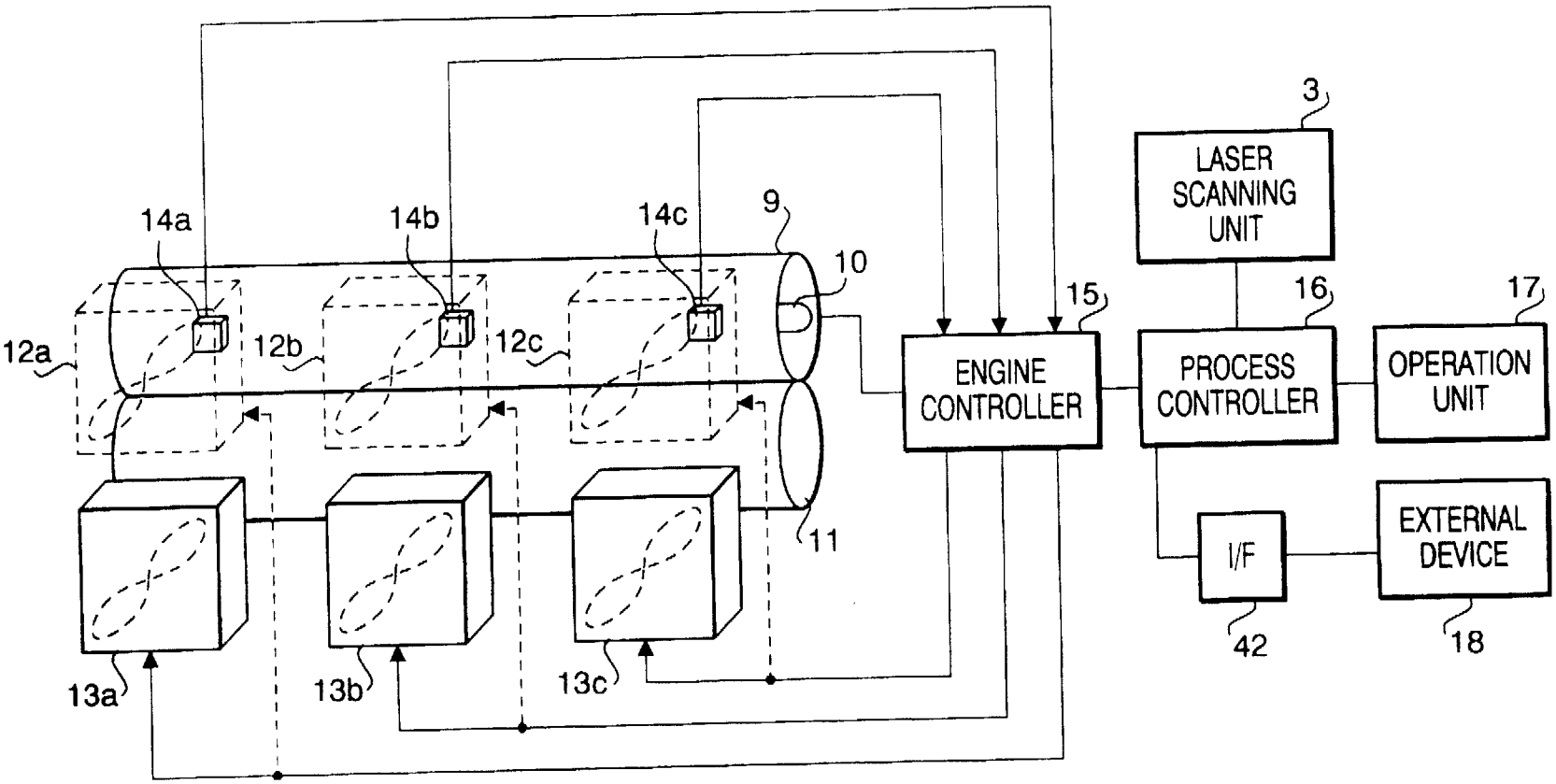
FIG. 2 shows a partial perspective view around the heat roller, including fans, thermistor thermometers, and controlling blocks.
Figure 3:
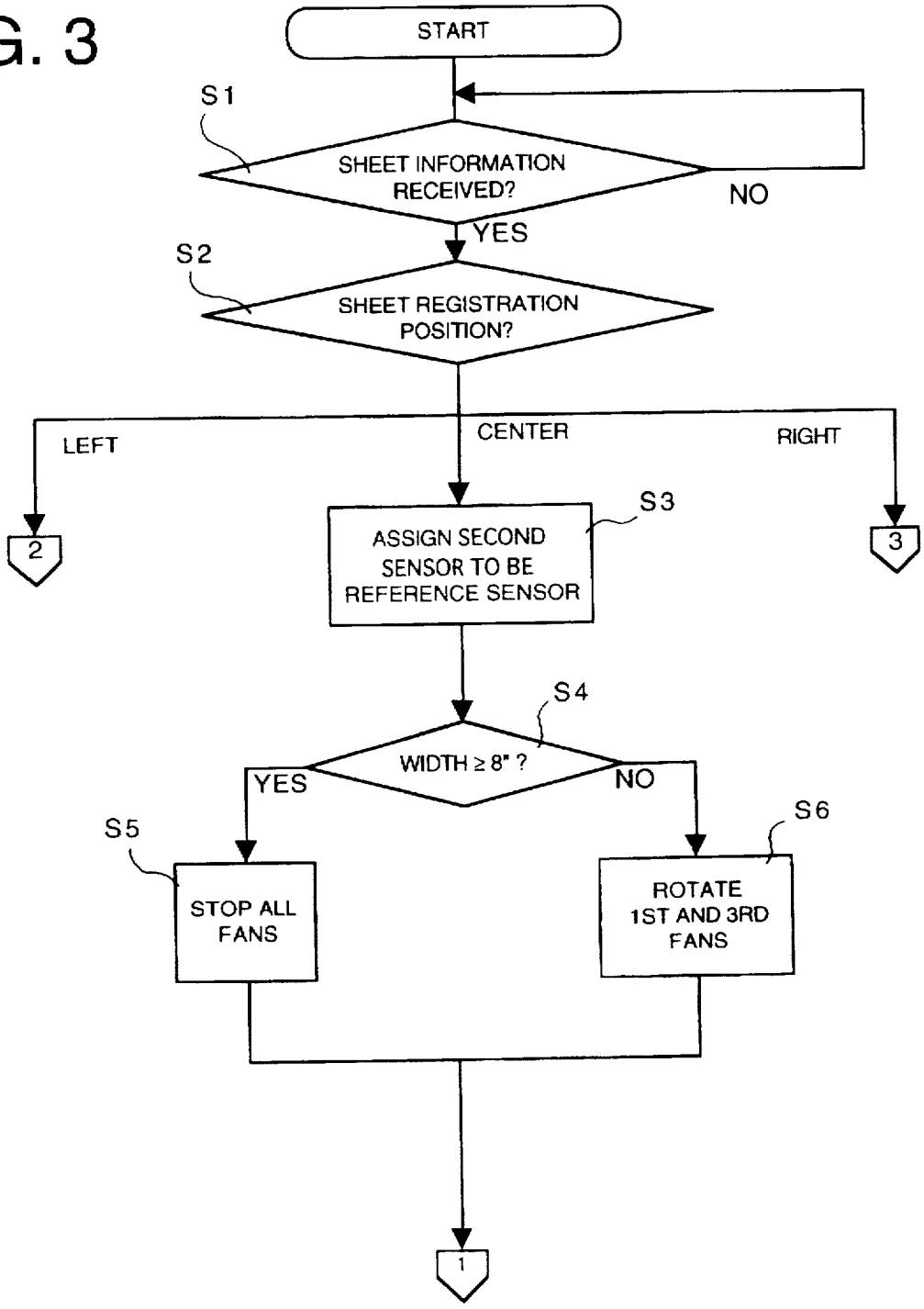
FIGS. 3 through 7 are flowcharts describing a temperature controlling process according to the first embodiment.

FIG. 2 is a partial perspective view of the area of the fixing unit 300 as viewed from the right-hand side in FIG. 1.

As shown in FIG. 2, the first, second and third upper and lower fans 12*a* through 12*c*, and 13*a* through 13*c*, and the sensors 14*a* through 14*c* are connected to the engine controller 15.

The first, second and third sensors 14*a*, 14*b* and 14*c* are provided to detect the temperature on the respective portions of the outer surface of the heat roller 9. The first, second and third sensors 14*a*, 14*b* and 14*c* respectively include thermistors, and the temperature at respective portions of the heat roller 9 is determined in accordance with the variation of the resistance of each thermistor.

As shown in FIG. 2, the first sensor 14*a*, the second sensor 14*b*, and the third sensor 14*c* are arranged apart from each other in the direction parallel to the rotational axis of the heat roller 9. Facing the first, second and third sensors 14*a*, 14*b* and 14*c*, the first upper fan 12*a*, the second upper fan 12*b*, and the third upper fan 12*c* are arranged for blowing air to cool the respective portions of the heat roller 9.

Similarly, the first, second and third lower fans 13*a* through 13*c* are arranged to blow air to cool the press roller 11 at portions corresponding to the portions of the heat roller 9 cooled by the first, second and third upper fans 12*a* through 12*c*.

The first upper fan 12*a* and the first lower fan 13*a*, the second upper fan 12*b* and the second lower fan 13*b*, and the third upper fan 12*c* and the third lower fan 13*c* are driven synchronously, in accordance with temperatures detected by the first, second and third sensors 14*a*, 14*b*, and 14*c*, respectively.

In the present embodiment, the maximum width of the loadable recording sheet P is 10 inches, and the distance between the first and third sensors 14*a* and 14*c* is more than 8 inches.

It should be noted that, even though, in the embodiment, three sensors 14*a* through 14*c*, and three upper and lower fans 12*a* through 12*c*, 13*a* through 13*c* are spaced substantially evenly apart, various other numbers of and arrangements of fans may be used depending on factors such as the type of registration, the maximum and minimum widths of loadable recording sheets, and the size of the printer. For example, if the minimum width of the recording sheet P which can be loaded in the printer 100 is greater than a half of the maximum width, the second sensor 14*b* may be positioned closer to the third sensor 14*c*.

As shown in FIG. 2, the first, second and third sensors 14*a*, 14*b* and 14*c* are connected to the engine controller 15. The upper and lower fans 12*a* through 12*c*, and 13*a* through 13*c* are also connected to the engine controller 15 and driven under control thereof. The engine controller 15 is also connected to a process controller 16. The process controller 16 is connected to an operation unit 17 through which a user can input various operation commands and operational parameters.

Further, the process controller 16 has an interface 42 through which the image data is transmitted from the external device 18. The image data also includes data representative of the image forming position on the recording sheet P. The width and the thickness of the recording sheet P may be input through the operation panel 17 by a user.

Based on such data, the engine controller 15 determines whether the center of the latent image should be adjusted to be the center of the width of the photoconductive drum 1, the left side of the latent image should coincide with the left end of an effective imaging area of the photoconductive drum, 1 or the right side of the latent image should coincide with the right side of the effective imaging area of the photoconductive drum 1. Then the imaging process is controlled accordingly.

The process controller 16 controls the laser scanning unit 3 to emit the scanning laser beam in accordance with the image data received through the interface 42. Simultaneously, the process controller 16 controls the engine controller 15 to drive the driving mechanisms 37 through 39, the transfer unit 7, and the developing unit 5 to perform an imaging operation.

While the laser beam printer 100 is in its operable state (i.e., ready for printing or when printing is in process)., the engine controller 15 drives the halogen lamp 10 to generate heat.

In accordance with the sheet registration type setting of the laser beam printer 100, and the width of the loaded recording sheet P, the portions, in the direction of the rotational axis, of the heat roller 9 and the press roller 11 which will come into contact with the recording sheet P(e.g., the portions of the heat roller 9 and the press roller 11 where the recording sheet P passes through) and the portions which will not come into contact with the recording sheet P (e.g., portions where the recording sheet P does not pass through) are determined. In this case, at least one of the sensors 14*a*, 14*b* and 14*c* corresponds to the portions where the recording sheet P passes through and is designated as a reference sensor. According to the temperature detected by the reference sensor, the halogen lamp is controlled to be ON or OFF. More specifically, the halogen lamp is turned ON or OFF so that the temperature detected by the reference sensor falls within an operable temperature range appropriate for fixing the toner image onto the recording sheet P.

Among the fans 12*a* through 12*c*, 13*a* through 13*c*, the fans corresponding to the portions through which the recording sheet P does not pass are driven to blow air. In this way, the portions of the heat roller 9 and the press roller 11 that do not come into contact with the recording sheet P, are cooled such that the temperature of these portions does not rise above a predetermined level. In the case that the thickness of the recording sheet P is greater, the operable temperature controlled based on the temperature detected by the reference sensor must be set higher. In such a case, the revolution speed of the fans for cooling the portions that do not come into contact with the recording sheet P is increased.

While printing is executed, the engine controller 15 detects the temperature distribution across the heat roller 9 in the direction of its rotational axis with reference to the temperature detected by the sensors 14*a*, 14*b* and 14*c*. If it is detected that the temperature at the portions that do not come into contact with the recording sheet P is much greater than that at the portion which the recording sheet P passes through, the revolution speed of the operated fans is increased so that the temperature distribution becomes flatter. If the temperature at the portions that do not come into contact with the recording sheet P is less than that at the portions that are in contact with the recording sheet P, the revolution speed of the operated fans is decreased so that the temperature distribution becomes flatter.

As described above, with reference to the temperature detected by the reference sensor, the range of the temperature distribution is controlled, and with reference to the temperature detected by the sensors other than the reference sensor, the revolution of the fans are controlled and the temperature distribution across the heat roller 9 as well as the press roller 11 is controlled.

As shown in FIG. 2, the first upper and lower fans 12*a* and 13*a* are connected and driven synchronously. The other pairs of upper and lower fans 12*b* and 13*b*, 12*c* and 13*c*, respectively are also driven synchronously.

Control of the fans 12*a* through 12*c*, and 13*a* through 13*c* will be described with reference to flowcharts shown in FIGS. 3 through 7.

The process shown in FIGS. 3 through 7 starts when the engine controller 15 begins to receive sheet information (data representative of the width and the thickness of the recording sheet P).

In step S1, the engine controller 15 determines whether the reception of the sheet information is completed. If the sheet information has not been completely received (S1:NO), S1 is repeated. When the engine controller 15 has finished receiving the sheet information (S1:YES), control proceeds to S2.

In step S2, control branches depending on the sheet registration type (i.e., left-side, center, or right-side registration). It should be noted that in this embodiment, the procedure shown in FIGS. 3 through 7 is designed such that whichever registration type is employed in a printer, temperature control can be achieved correctly. Alternatively, for a printer that uses only one registration type, it is possible to use only the steps corresponding to the particular sheet registration type of the process shown in FIGS. 3 through 7

Figure 4:
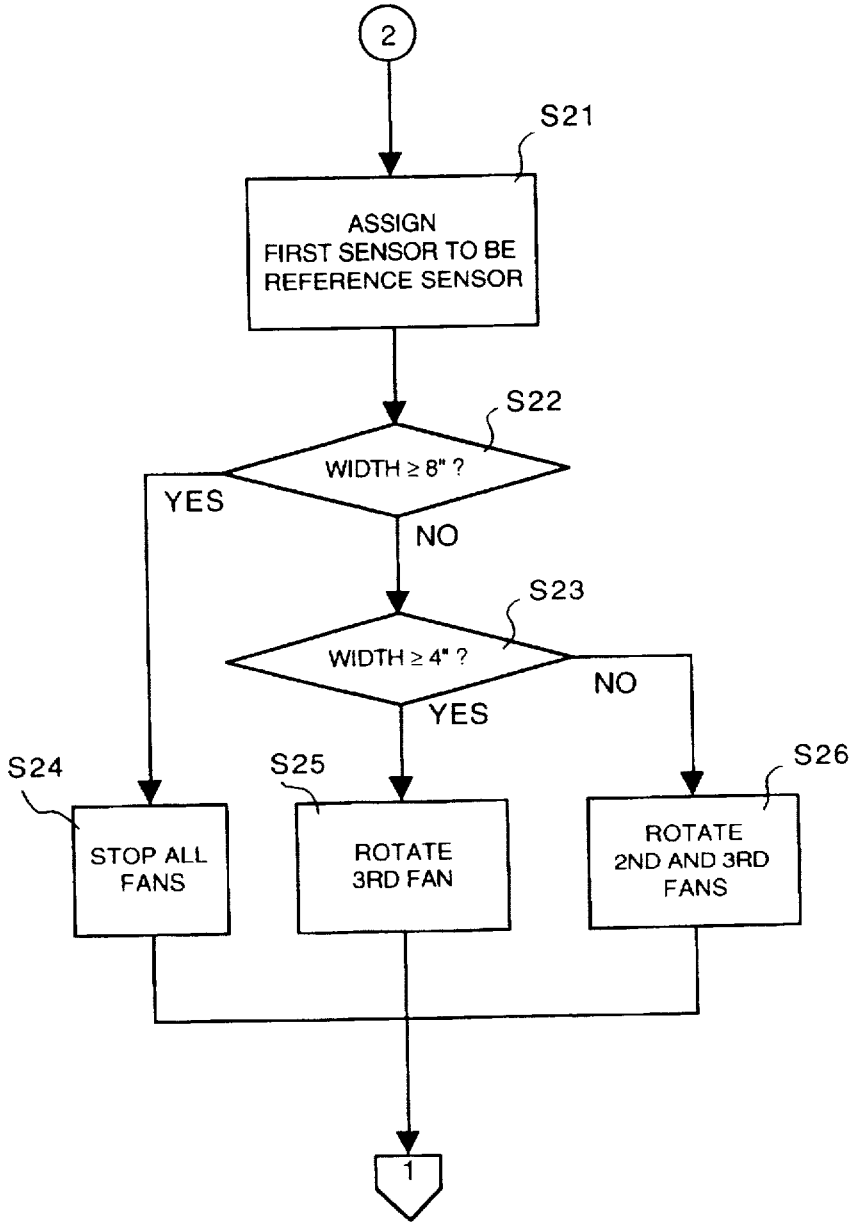

If the selected registration type is the left-side registration type, control proceeds to step 21 of FIG. 4. If the selected registration type is the right-side registration type, control proceeds to step 31 shown in FIG. 5. If the printer is the center registration type, control proceeds to step 3.

In step 3, the engine controller 15 assigns the second sensor 14*b* as the reference sensor. That is, in accordance with the temperature of the heat roller 9 detected by the second sensor 14*b*, the halogen lamp is turned ON or OFF so that the temperature of the heat roller 9 stays within a predetermined operable temperature range, which is appropriate for fixing the toner image onto the recording sheet P.

In step 4, based on the received sheet information, the engine controller 15 determines whether the width of the loaded recording sheet is equal to or greater than 8 inches. As described above, the maximum width of the recording sheet P which can be loaded in the laser printer 100 of this embodiment is 10 inches. If the width of the loaded recording sheet P is equal to or greater than 8 inches, it is highly likely that the recording sheet P extends across almost the entire portion of the nip between the heat roller 9 and the press roller 11. Accordingly, an uneven temperature distribution in the width direction of the heat roller 9 will generally not occur, and therefore it is unnecessary to actuate any of the fans 12*a* through 12*c*, and 13*a* through 13*c*.

Accordingly, if the width of the recording sheet P is equal to or greater than 8 inches (S4:YES), the engine controller 15 stops driving all the fans 12*a* through 12*c*, and 13*a* through 13*c*. If the width of the recording sheet P is less than 8 inches (S4:NO), control proceeds to step S6 where the engine controller 15 controls the right and left fans 12*a*, 12*c*, 13*a* and 13*c* to rotate. The fans 12*a*, 12*c*, 13*a* and 13*c* are rotated because the ends of the heat roller 9 tend to have a high temperature when the width of the recording sheet P is less than 8 inches. In this embodiment, the revolution speed of each fan is the same (i.e., the revolution speed of each fan is NR)- After either step S5 or Step S6, control proceeds to step S11 of FIG. 6.

If the selected registration type is the left-side registration type, control proceeds from step S2 (FIG. 33 to step S21 (FIG. 4). In this case, the first sensor 14*a* is assigned to be the reference sensor. That is, the halogen lamp 10 is turned ON or OFF in accordance with the temperature detected by the first sensor 14a.

In step S22, the engine controller 15 determines whether the width of the recording sheet P is equal to or greater than 8 inches. If the width of the recording sheet P is equal to or greater than 8 inches (Step S22:YES), all the fans 12a through 12c, and 13a through 13c are stopped (Step S24) since the width of the recording sheet P is sufficiently long with respect to the length of the heat roller 9 and the temperature of the heat roller 9 does not rise beyond a predetermined limit.

If the width of the recording sheet P is less than 8 inches (Step S22:NO), the engine controller 15 determines whether the width of the recording sheet P is equal to or greater than 4 inches (Step S23). If the width of the recording sheet P is equal to or greater than 4 inches (Step S23:YES), then the third upper and lower fans 12c and 13c are actuated (Step S25) since the center area of the heat roller 9 is in contact with the recording sheet P. The revolution speed of the third upper and lower fans 12c and 13c when they are actuated at step S25 is NR. If the width of the recording sheet P is less than 4 inches (Step S23:NO), the second and third upper and lower fans 12b, 12c, 13b and 13c are actuated (Step S26) at the revolution speed of NR since the related areas of the heat roller 9 are not in contact with the recording sheet P and may overheat.

Figure 6:
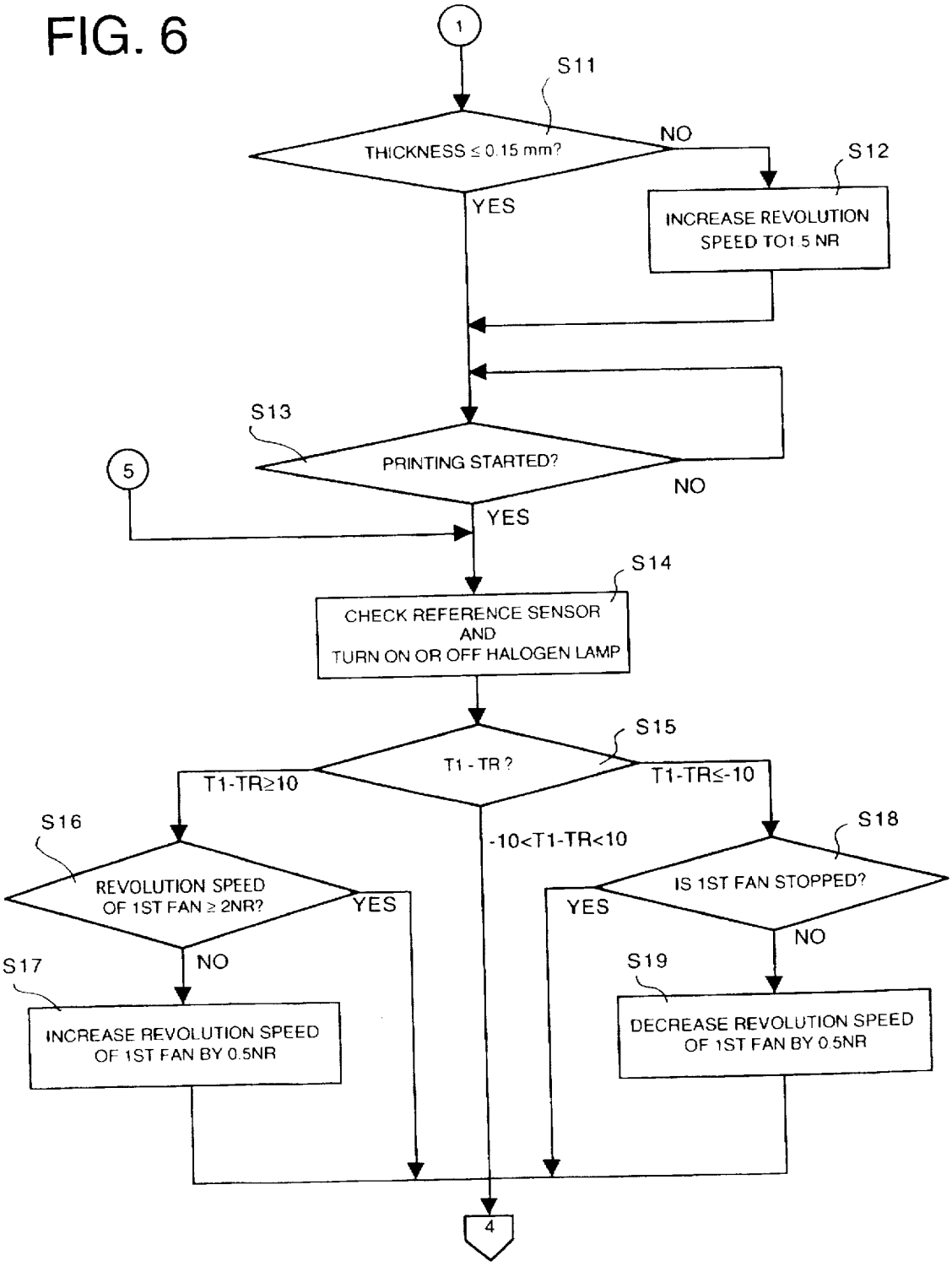

After one of steps S24, S25 or S26 is executed, control proceeds to S11 of step FIG. 6.

Figure 5:
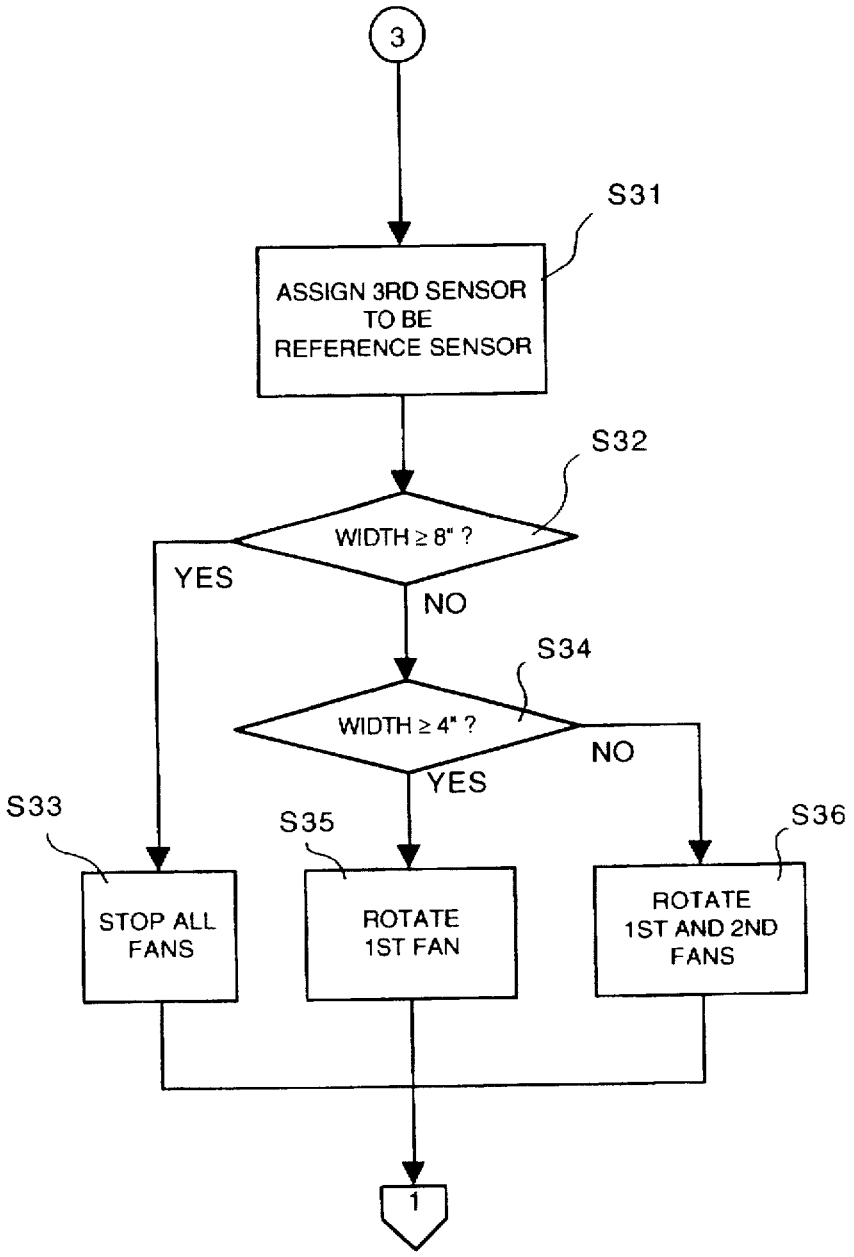

If the selected registration type is the right-side registration type, control proceeds from step S2 (FIG. 3) to Step S31 (FIG. 5). In this case, the third sensor 14c is assigned to be the reference sensor. That is, the halogen lamp 10 is turned ON or OFF in accordance with the temperature detected by the third sensor 14c.

In step S32, the engine controller 15 determines whether the width of the recording sheet P is equal to or greater than 8 inches. If the width of the recording sheet P is equal to or greater than 8 inches (Step S32:YES), all the fans 12a through 12c, and 13a through 13c are stopped (Step 33) since the width of the recording sheet P is sufficiently long with respect to the length of the heat roller 9 and the temperature distribution across the heat roller 9 stays substantially even.

If the width of the recording sheet P is less than 8 inches (Step S32:NO), the engine controller 15 determines whether the width of the recording sheet P is equal to or greater than 4 inches (Step S34). If the width of the recording sheet P is equal to or greater than 4 inches (Step S34:YES), then only the first upper and lower fans 12a and 13a are actuated at the revolution speed of NR (Step S35) since the center area of the heat roller 9 is in contact with the recording sheet P. If the width of the recording sheet P is less than 4 inches (Step S34:N0), the first and second upper and lower fans 12a, 12b, 13a and 13b are actuated (Step S36) at the revolution speed of NR since the related areas of the heat roller 9 are not in contact with the recording sheet P and may overheat.

After one of steps S33, S35 or S36 is executed, control proceeds to step S11 of FIG. 6.

At step S11 in FIG. 6, it is determined whether the thickness of the recording sheet P is less than or equal to 0.15 mm. If the thickness of the recording sheet P is equal to or less than 0.15 mm:(Step S11:YES), control proceeds to step S13. If the width of the recording sheet P is greater than 0.15 mm (Step S11:NO), then the revolution speed of the fans is changed to 1.5×NR.

In step S13, the engine controller 15 waits (Step S13:NO) until the process controller 16 starts the printing operation. When the process controller 16 starts printing (Step S13:YES), the engine controller detects the temperature of the heat roller 9 using the reference sensor (one of 14a, 14b or 14c). Then, based on the detected temperature, the halogen lamp 10 is controlled to be -turned OFF or ON (Step S14). That is, if the detected temperature is greater than the upper limit of the operable temperature range, the halogen lamp 10 is turned OFF; and if the halogen lamp is OFF and the detected temperature is less than the lower limit of the operable temperature range, the halogen lamp 10 is turned ON.

In the description hereinafter, the temperature detected by the first sensor 14a is referred to as temperature T1; the temperature detected by the second sensor 14b is referred to as temperature T2; the temperature detected by the third sensor 14c is referred to as temperature T3; and the temperature detected by the reference sensor is referred to as temperature TR.

In step S15, temperatures T1 and TR are compared. Note that if the first sensor 14a has been designated as the reference sensor, the difference between the compared temperatures is zero (i.e., T1−TR=0). Thus, in the following steps, there is no actuation of the fans (i.e., fans 12a and 13a) corresponding to the reference sensor.

If T1−TR≧10 at step S15, control proceeds to step S16. If the revolution speed of the first upper and lower fans 12a and 13a is less than 2×NR (Step S16:.NO), the revolution speed is increased by 0.5×NR (Step S17) It should be noted that if the first upper and lower fans 12a and 13a are stopped when control comes to step S17, the engine controller 15 starts rotating the fans 12a and 13a with the revolution speed being 0.5×NR. Thereafter, control proceeds to step S41 of FIG. 7. If the revolution speed of the first upper and lower fans 12a and 13a is equal to or greater than 2×NR (Step S16:YES), the revolution speed of the fans is not changed, and control proceeds to step S41 of FIG. 7.

Figure 7:
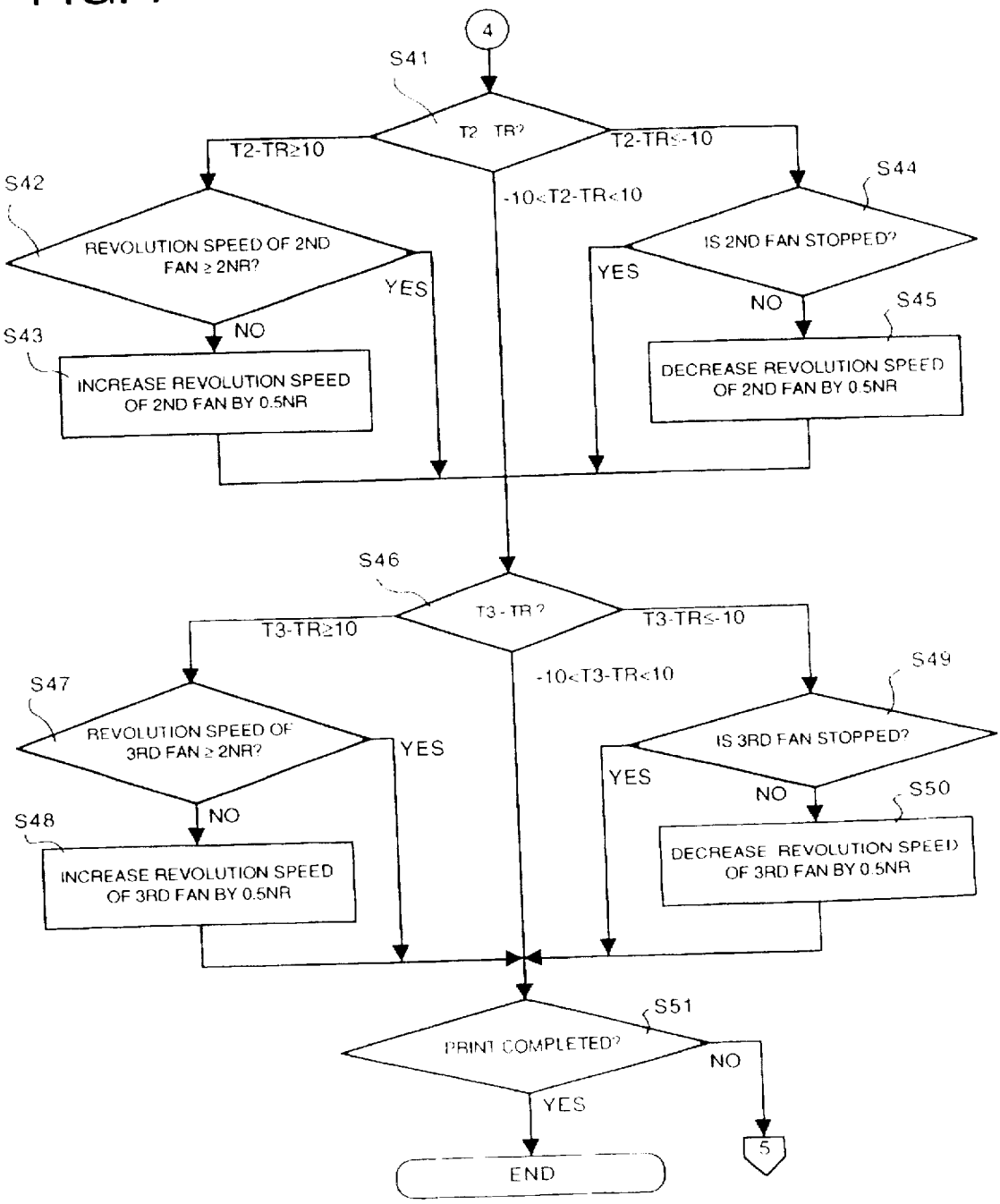

If T1−TR is greater than −10, and less than +10 at S15, the status of the first upper and lower fans 12a and 13a is unchanged, and control proceeds to step S41 of FIG. 7.

If T1−TR ≦−10, the engine controller 15 determines, at S18, whether the first upper and lower fans 12a and 13a are stopped. If the first upper and lower fans 12a and 13a are actuated (Step S18:NO), then the revolution speed of the fans 12a and 13a is decreased by 0.5×NR (Step S19). Thereafter, control proceeds to S41 of FIG. 7. Note that if the current revolution speed of the fans 12a and 13a is 0.5×NR, the fans 12a and 13a are controlled to stop rotating.

If the first upper and lower fans 12a and 13a are stopped (Step S18:YES) when the determination is made at step S18, control proceeds to step S41 of FIG. 7 without changing the status of the fans.

In step S41 of FIG. 7, temperatures T2 and TR are compared. If the second sensor 14b has been designated as the reference sensor, the difference between the compared temperatures is zero (i.e., T2×TR=0), and there is no actuation of the fans (i.e., fans 12b and 13b) corresponding to the reference sensor (i.e., the second sensor 14b).

If T2−TR≧10 at step S41, control proceeds to step S42. If the revolution speed of the second upper and lower fans 12b and 13b is less than 2×NR (Step S42:NO), the revolution speed thereof is increased by 0.5×NR (Step S43). If the second upper and lower fans 12b and 13b are stopped, the engine controller 15 starts rotating the fans 12b and 13b with the revolution speed being 0.5×NR. Thereafter, control proceeds to step S46. If the revolution speed of the second upper and lower fans 12b and 13b is equal to or greater than 2×NR (Step S42:YES), the revolution speed of the fans 12b and 13b is not changed, and control proceeds to step S46.

If T2−TR is greater than −10, and less than +10 at step S41, the status of the second upper and lower fans 12b and 13b is unchanged, and control proceeds to step S46.

If T2−TR≦−10, the engine controller 15 determines, at step S44, whether the second upper and lower fans 12b and 13b are stopped. If the first upper and lower fans 12b and 13b are actuated (Step S44:NO), then the revolution speed of the fans 12b and 13b is decreased by 0.5×NR (Step S45). Thereafter, control proceeds to step S46. Note that if the current revolution speed of the fans 12b and 13b is 0.5×NR, the fans 12b and 13b are controlled to stop rotating.

If the second upper and lower fans 12b and 13b are stopped (Step S44:YES) when the determination is made at step S44, control proceeds to step S46 without changing the status of the fans.

In step S46, temperatures T3 and TR are compared. If the third sensor 14c has been designated as the reference sensor, the difference between the compared temperatures is zero (i.e., T3−TR=0), and there is no actuation of the fans (i.e., fans 12c and 13c) corresponding to the reference sensor (i.e., the third sensor 14c).

If T3−TR≧10 at step S46, control proceeds to step S47. If the revolution speed of the third upper and lower fans 12c and 13c is less than 2×NR (Step S47:NO), the revolution speed thereof is increased by 0.5×NR (Step S48). If the third upper and lower fans 12c and 13c are stopped, the engine controller 15 starts rotating the fans 12c and 13c with the revolution speed being 0.5×NR. Thereafter, control proceeds to step S51. If the revolution speed of the third upper and lower fans 12c and 13c is equal to or greater than 2×NR (S47:YES), the revolution speed of the fans 12c and 13c is not changed, and control proceeds to step S51.

If T3−TR is greater than −10, and less than +10 at step S46, the status of the third upper and lower fans 12c and 13c is unchanged, and control proceeds to step S51.

If T3−TR≦−10, the engine controller 15 determines, at step S49, whether the third upper and lower fans 12c and 13c are stopped. If the third upper and lower fans 12c and 13c are actuated (Step S49:NO), then the revolution speed of the fans 12c and 13c is decreased by 0.5×NR (Step S50). Thereafter, control proceeds to step S51. Note that if the current revolution speed of the fans 12c and 13c is 0.5×NR, the fans 12c and 13c are controlled to stop rotating.

If the third upper and lower fans 12c and 13c are stopped (Step S49:YES) when the determination is made at step S49, control proceeds to step S51 without changing status of the fans.

At step S51, the engine controller 15 determines whether the printing operation has been completed. If the printing operation has not completed (Step S51:NO), control returns to step S14 of FIG. 6, and the process described above is repeated if the printing has completed (Step S51:YES) control according to the current process ends.

In the first embodiment, in order to control the fans 12a, 12b, 12c, 13a, 13b and 13c, temperatures detected by the sensors 14a, 14b and 14c are compared with each other However, since the temperature of the heat roller 9 is to be accurately controlled such that the temperature does not exceed the operable range, instead of comparing the detected temperatures with each other, A similar control can be done by comparing the temperature detected by each sensor with predetermined values.

Figure 8:
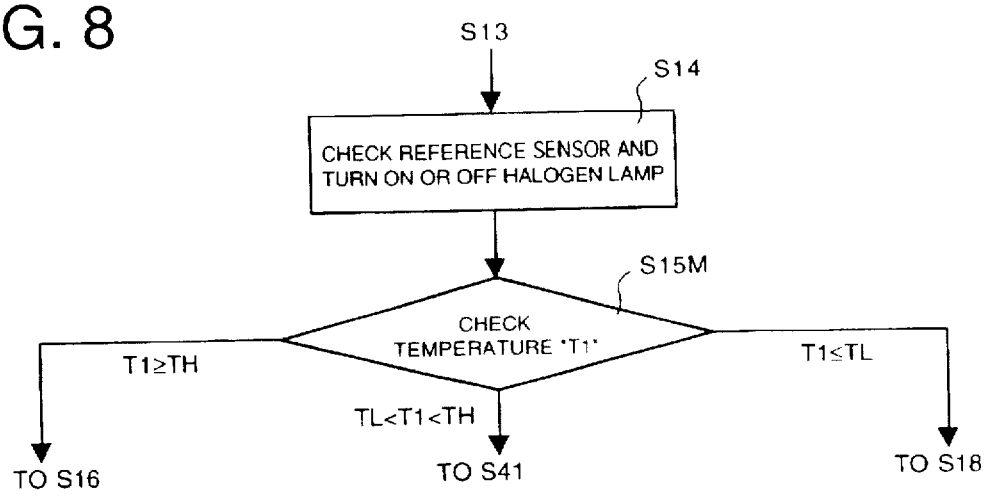
FIGS. 8 through 10 show alternative steps for a second embodiment.
Figure 9:
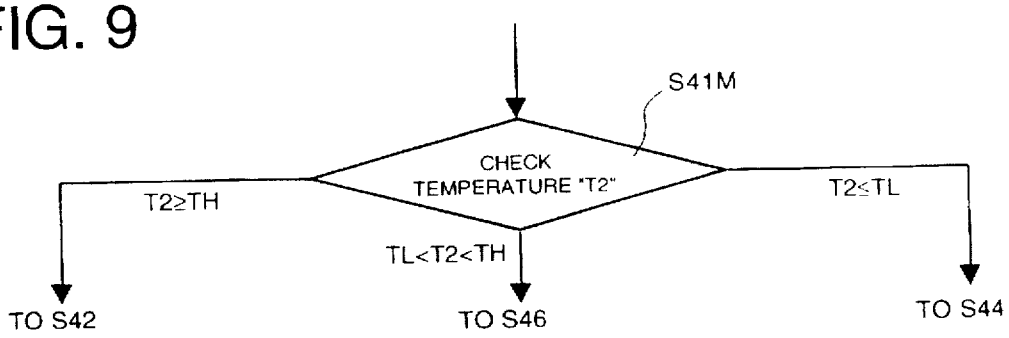
Figure 10:
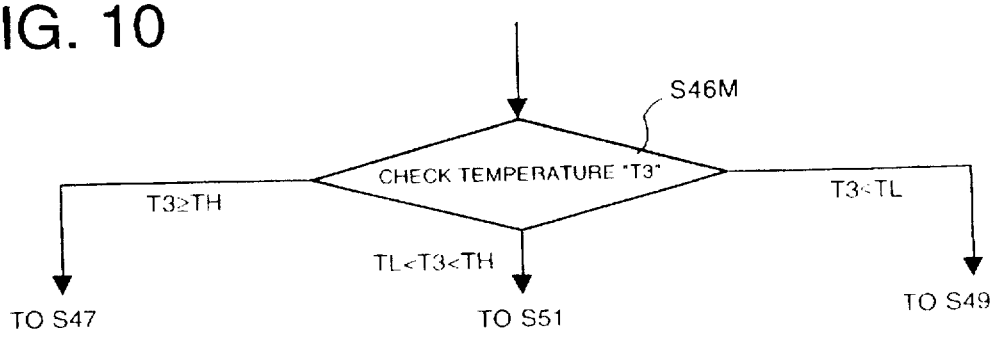

FIGS. 8 through 10 show steps illustrating the above feature of a second embodiment.

Steps S15M, S41M and S46M replace steps S15, S41 and S46 of the first embodiment, respectively.

In step S15M (shown in FIG. 8, which replaces step S15 of FIG. 6), temperature T1 is examined. If temperature T1 is equal to or greater than a predetermined upper limit TH, control goes to step S16; if temperature T1 is equal to or less than a predetermined lower limit TL, control goes to step S18; and otherwise (i.e., TL<T1<TH), control goes to step S41M.

Similarly, in step S41M (shown in FIG. 9,which replaces step S41 of FIG. 7), temperature T2 is examined. If temperature T2 is equal to or greater than the predetermined upper limit TH, control goes to step S42; if temperature T2 is equal to or less than the predetermined lower limit TL, control goes to step S44; and otherwise (i.e., TL<T2<TH), control goes to step S46M.

Similarly, in step S46M (shown in FIG. 10, which replaces step S46 of FIG. 7), temperature T3 is examined. If temperature T3 is equal to or greater than the predetermined upper limit TH, control goes to step S47; if temperature T3 is equal to or less than the predetermined lower limit TL, control goes to step S49; and otherwise (i.e., TL<T3<TH), control goes to step S51.

Figure 11:
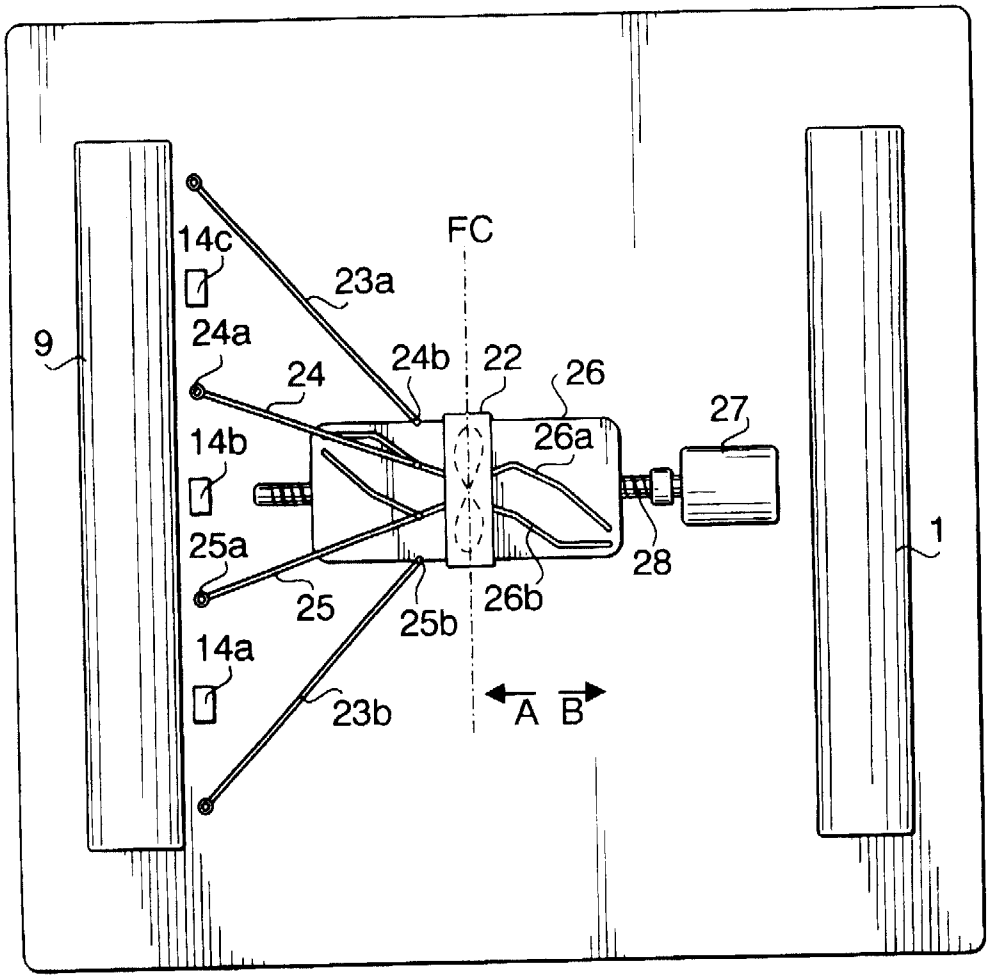
FIG. 11 is plan view of a temperature controlling device according to a third embodiment of the invention.
Figure 12:
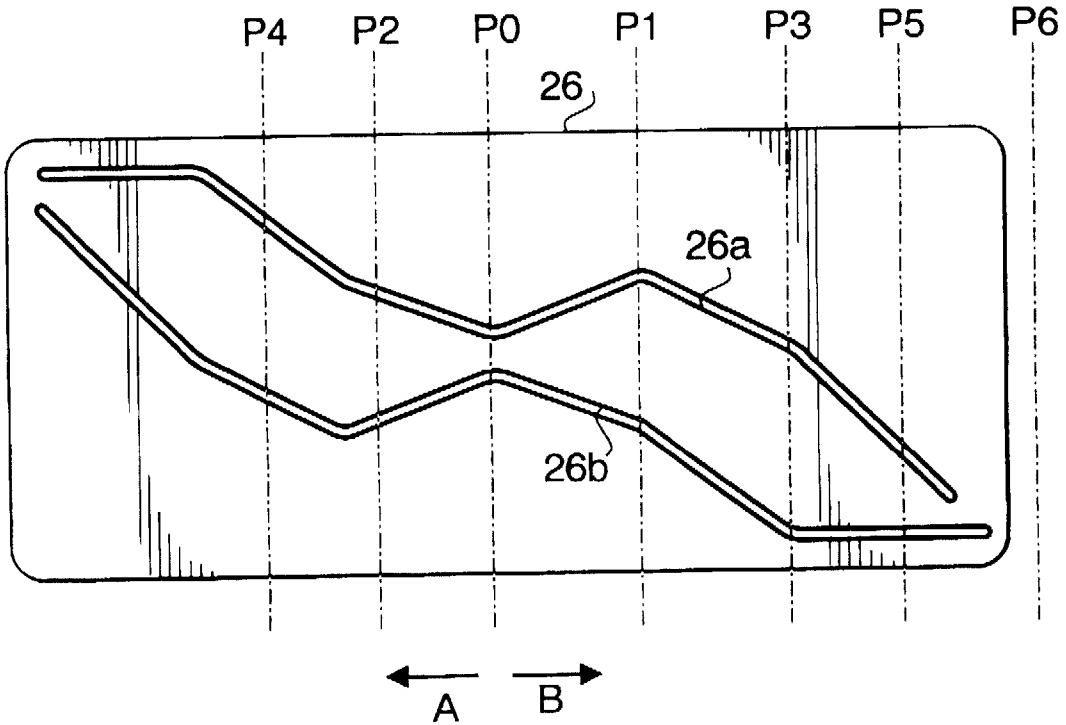
FIG. 12 is a plan view of a partition adjusting plate of the third embodiment.

FIGS. 11 and 12 show a temperature controlling device according to a third embodiment.

In FIG. 11, in order to simplify the drawing and description, a structure that is provided on one side (for example, the upper side) of the feed path of the recording sheet P is shown. A similar structure is provided on the opposite side of the feed path. Alternatively, a structure similar to that of the first embodiment can be used on the opposite side. Further, the structure shown in FIG. 11 can be employed on the lower side of the feed path with a structure similar to that of the first embodiment being employed on the upper side of the feed path In this embodiment, components similar to those used in the first embodiment use the same reference numerals.

According to the third embodiment shown in FIG. 11, a single fan 22 is provided on the upper side of the feed path. Partition plates 23a and 23b are provided between the side ends of the fan 22 and the ends of the heat roller 9, respectively, for preventing air blown towards the-heat roller 9 from diffusing. The partition plates 23a and 23b respectively have planes extending in a direction perpendicular to the plane of FIG. 11.

Between the partition plates 23a and 23b, movable partition plates 24 and 25 are provided. The partition plates 24 and 25 also have planes that extend in the direction perpendicular to the plane of FIG. 11. The movable partition plates 24 and 25 are rotatably supported by shafts 24a and 25a, respectively. The shafts 24a and 25a are perpendicular to the plane of FIG. 11 and are disposed at positions which divide the length between the heat-roller-side ends of the partition plates 23a and 23b substantially evenly. The movable partition plates 24 and 25 are also provided with cam pins 24b and 25b, respectively.

The widths of the plates 23a, 23b, 24 and 25 in the direction perpendicular to the plane of FIG. 11 is substantially the same as or slightly larger than the diameter of the heat roller 9.

Between the fan 22 and the feed path (or the recording sheet P), a partition adjusting plate 26 is provided. On the lower side (on the side opposite to the fan 22) of the adjusting plate 26, a ball nut (not shown) is fixed and arranged to engage with a ball screw 28. The ball screw 28 is connected to a motor 27. Therefore, by rotating the ball screw 28 using the motor 27, the adjusting plate 26 can be moved along the sheet feed direction (indicated by arrows A and B)

As shown in FIG. 11, and in an enlarged plan view in FIG. 12, the adjusting plate 26 is formed with a pair of cam grooves 26*a* and 26*b*, in which the cam pins 24*b* and 25*b* are fitted. As the adjusting plate 26 is moved in the direction A or B, the movable partition plates 24 and 25 rotate about the shafts 24*a* and 25*b*, respectively.

As a result of the movement of the movable partition plates 24 and 25, the shapes of ducts formed by the partition plates 23*a*, 23*b*, 24 and 25 are changed. Accordingly, by shifting the position of the adjusting plate 26, the portions of the heat roller 9 to which air is introduced can be changed.

In FIG. 11, a reference line FC is indicated, and in FIG. 12, position lines on the adjusting plate 26 are indicated. In FIG. 12, line P0 of the adjusting plates 26 coincides with the reference position FC. In this condition, the movable partition plates 24 and 25 substantially evenly divide the area defined by the partition plates 23*a* and 23*b*. Accordingly, substantially the same amount of air is introduced towards the areas corresponding to the first, second and third sensors 14*a*, 14*b* and 14*c*.

If the adjusting plate 26 is positioned such that line P4 coincides with the reference line FC, the ducts formed between the partition plate 23*a* and the movable partition plate 24 and between the movable partition plates 24 and 25 are substatially closed. Accordingly, a greater amount of air is introduced to the left side (viewed from the top right in FIG. 11 of the heat roller 9), that is, into the duct between the movable partition plate 25 and the partition plate 23*b*.

If the adjusting plate 26 is positioned such that line P0 coincides with the reference line FC, the duct formed between the partition plate 23*a* and the movable partition plate 24 is substantially closed. Accordingly, the air is introduced to the left side (viewed from the top right in FIG. 11) and the central areas of the heat roller 9.

If the adjusting plate 26 is positioned such that line P0 coincides with the reference line PC, as shown in FIG. 11 and described above, the air is introduced to the entire area of the heat roller 9.

If the adjusting plate 26 is positioned such that line P1 coincides with the reference line FC, the duct formed between the movable partition plates 24 and 25 is closed. Accordingly, air is blown to both end portions (left and right areas viewed from the top right in FIG. 11) of the heat roller 9.

If the adjusting plate 26 is positioned such that line P3 coincides with the reference line FC, similarly to the case where the line P0 coincides with the reference line FC, the air is introduced to entire area of the heat roller 9.

If the adjusting plate 26 is positioned such that line P5 coincides with the reference line FC, the duct formed between the partition plate 23*b* and the movable partition plate 25 is substantially closed. Accordingly, the air is introduced to the right side (upper side in FIG. 11) and the central areas of the heat roller 9.

If the adjusting plate 26 is positioned such that line P6 coincides with the reference line FC, the ducts formed between the partition plate 23*b* and the movable partition plate 25 and between the movable partition plates 24 and 25 are substantially closed. Accordingly, the air is introduced to the right side (upper side in FIG. 11) of the heat roller 9.

The operation of the third embodiment is now described.

Similar to the operation of the first embodiment, depending on the sheet registration type of the printer 100, the reference sensor is assigned. Then, depending on the width of the recording sheet P, the area(s) of the heat roller 9 to be cooled is determined. In the first embodiment, for cooling the heat roller 9, the upper fans 12*a*, 12*b* and 12*c* are selectively actuated. In the third embodiment, instead of activating selected fans, the position of the adjusting plate 26 is determined for introducing air to respective areas. The correspondence between the fans 12*a*, 12*b* and 12*c* of the first embodiment and the positions of the adjusting plate 26 of the third embodiment is indicated in Table 1 below.

TABLE 1

| Position | P0 | P1 | P2 | P3 | P4 | P5 | P6 |
|---|---|---|---|---|---|---|---|
| Fans | all | 12a, 12c | 12a, 12b | all | 12a | 12b, 12c | 12c |

If the registration type of the printer 100 is the left-side registration type, the first sensor 14*a* is assigned to be the reference sensor. If the width of the recording sheet P is less than 8 inches, the fan 22 is actuated. If the width of the recording sheet P is less than 8 inches and greater than or equal to 4 inches, the adjusting plate is positioned such that line P6 coincides with the reference line FC. If the width of the recording sheet P is less than 4 inches, the adjusting plate 26 is position such that the line P5 coincides with the reference line FC.

If the registration type of the printer 100 is the center registration type, the second sensor 14*b* is assigned to be the reference sensor. If the width of the recording sheet P is less than 8 inches, the fan 22 is actuated and the adjusting plate 26 is positioned such that line P1 coincides with the reference line FC.

If the registration type of the printer 100 is the right-side registration type, the third sensor 14*c* is assigned to be the reference sensor If the width of the recording sheet P is less than 8 inches, the fan 22 is actuated. If the width of the recording sheet P is less than 8 inches and greater than or equal to 4 inches, the adjusting plate is positioned such that line P4 coincides with the reference line FC. If the width of the recording sheet P is less than 4 inches, the adjusting plate 26 is position such that line P2 coincides with the reference line PC.

Similar to step S11 and step S12 in FIG. 6, if the thickness of the recording sheet P is greater than 0.15 mm, the revolution speed of the fan 22 is increased by 0.5×NR.

When the first sensor 14*a* is assigned to be the reference sensor, (1) if temperatures T2 and T3 are both greater than T1 by more than 10 degrees, the adjusting plate 26 is positioned such that line P5 coincides with the reference line PC; and (2) if only temperature T3 is greater than T1 by more than 10 degrees, the adjusting plate 26 is positioned such that line P6 coincides with the reference line FC.

When the second sensor 14*b* is assigned to be the reference sensor, (1) if temperatures T1 and T3 are both greater than T2 by more than 10 degrees, the adjusting plate 26 is positioned such that line PI coincides with the reference line FC;

(2) if only temperature T1 is greater than T2 by more than 10 degrees, the adjusting plate 26 is positioned such that line P4 coincides with the reference line FC; and (3) if only temperature T3 is greater than T2 by more than 10 degrees, the adjusting plate 26 is positioned such that line P6 coincides with the reference line FC; and When the third sensor 14*c* is assigned to be the reference sensor, (1) if temperatures T1 and T2 are both greater than T3 by more than 10 degrees, the adjusting plate 26 is positioned such that line P2 coincides with the reference line FC; and (2) if only temperature T1 is greater than T3 by more than 10 degrees, the adjusting plate 26 is positioned such that line P4 coincides with the reference line FC.

In association with the above operation, the revolution speed of the fan 22 can also be varied to obtain a substantially even temperature distribution across the heat roller 9.

As mentioned before, the third embodiment is described with reference to the temperature control for the heat roller 9. However, temperature control of the third embodiment can be applied to provide temperature control of the press roller 11 as well.

As described above, according to the invention, the unevenness of the temperature distribution of the heat roller as well as the press roller which occurs when the width of the recording sheet is relatively small with respect to the width of the heat roller and the press roller can be prevented without requiring adjustment to the power supply to the heat source.

The present disclosure relates to subject matter contained in Japanese Patent Application No. HEI 8-23975, filed on Feb. 9, 1996, which is expressly incorporated herein by reference in its entirety.

What is claimed is:

1. A temperature controlling device for an electrophotographic imaging device having a fixing unit that includes a heat roller, said fixing unit performing a fixing function in which toner is fixed on a recording sheet, said temperature controlling device comprising:

a temperature sensing system, arranged about an outer surface of said heat roller such that, for the purposes of temperature measurement, said heat roller is divided into a plurality of areas along a rotational axis of said heat roller, a temperature of each area being detected by said temperature sensing system;

an air blowing system which blows air to each of said plurality of areas separately, said air blowing system including a fan; and a controller which controls said air blowing system to blow air in accordance with temperatures of said plurality of areas and which controls distribution of air, adjacent said fan, to be distributed to said plurality of areas in accordance with temperatures of said plurality of areas.

2. The temperature controlling device according to claim 1, wherein said plurality of areas include at least one first area which contributes to said fixing operation, and at least one second area which does not contribute to said fixing operation, and wherein said controller controls said air blowing system to blow air only to said second area.

3. The temperature controlling device according to claim 2, wherein said controller controls said air blowing system to increase an amount of air to be blown to said second area when a temperature of said second area exceeds a first predetermined value.

4. The temperature controlling device according to claim 2, wherein said controller controls said air blowing system to decrease an amount of air to be blown to said second area when a temperature of said second area is less than a second predetermined value.

5. The temperature controlling device according to claim 2, wherein said controller controls said air blowing system to increase an amount of air to be blown to said second area when a temperature of said second area exceeds a temperature of said first area by a predetermined amount.

6. The temperature controlling device according to claim 2, wherein said controller controls said air blowing system to decrease an amount of air to be blown to said second area when a temperature of said second area is lower than a temperature of said first area by a predetermined amount.

7. The temperature controlling device according to claim 1, said temperature sensing system comprising a plurality of temperature sensors that respectively detect temperatures of said plurality of areas.

8. The temperature controlling device according to claim 1, said air blowing system comprising at least one fan and a plurality of partition members defining a plurality of ducts, said plurality of partition members extending from said at least one fan to said heat roller, wherein a configuration of said plurality of partition members is changeable, at an end of said plurality of partition members adjacent to said at least one fan, so that air is introduced to selected ducts directed to selected areas selected from among said plurality of areas.

9. The temperature controlling device according to claim 8, further comprising a mechanism for changing said configuration of said plurality of partition members, wherein said controller drives said changing mechanism in accordance with a temperature of each area detected by said temperature sensing system.

10. The temperature controlling device according to claim 9, said plurality of partition members comprising a plurality of plate members, two outermost plate members of said plurality of plate members being fixed at predetermined positions, an inner plate member of said plurality of plate members being movable ducts.

11. The temperature controlling device according to claim 1, said fixing unit further comprising a press roller, said press roller being positioned to form a nip between said heat roller and said press roller, said press roller being divided, for the purposes of temperature measurement, into a plurality of areas, said temperature controlling device further comprising a second air blowing system which blows air to said plurality of areas of said press roller, wherein said controller drives said second air blowing system to blow air to said plurality of areas of said press roller selectively in accordance with temperatures of said plurality of areas of said heat roller.

12. The temperature controlling device according to claim 1, said plurality of areas including at least one reference area, wherein said controller controls said air blowing system such that a temperature difference between said reference area and each other area of said plurality of areas is within a predetermined temperature range.

13. The temperature controlling device according to claim 1, said controller including a movable partition member, wherein movement of said movable partition member increases an air flow to one of said plurality of areas while simultaneously decreasing an air flow to another of said plurality of areas.

14. A temperature controlling device for an electrophotographic imaging device which has a fixing unit including a heat roller, said temperature controlling device comprising:

a temperature distribution system, which detects a temperature distribution of said heat roller in a direction parallel to a rotational axis of said heat roller;

an air blowing system which blows air to any one of a plurality of predetermined areas of said heat roller, said plurality of predetermined areas being arranged along said rotational axis of said heat roller, said air blowing system including at least one fan; and a controller which drives said air blowing system such that said temperature distribution stays substantially even by controlling distribution of air, adjacent to said at least one fan, to be distributed to said plurality of predetermined areas in accordance with temperatures of said plurality of predetermined areas.

15. The temperature control device according to claim 14, said air blowing system comprising a plurality of partition members defining a plurality of ducts extending from said at least one fan to said heat roller, said plurality of partition members comprising a plurality of plate members, two outermost plate members of said plurality of plate members being fixed at predetermined positions, at least one inner plate member of said plurality of plate members being movable to form said plurality of ducts.

16. The temperature controlling device according to claim 14, said temperature distribution system comprising a plurality of temperature sensors that detect temperatures of said plurality of predetermined areas.

17. The temperature controlling device according to claim 14, said controller including at least one movable adjusting plate, movement of said adjusting plate increasing a flow of air to one of said predetermined areas while simultaneously decreasing a flow of air to another of said plurality of predetermined areas.

18. A temperature controlling device for an electrophotographic imaging device which has a fixing unit including a heat roller, said temperature controlling device comprising:

a temperature distribution controlling system which controls a temperature distribution of said heat roller in a direction parallel to a rotational axis of said heat roller such that a temperature differential between predetermined portions of said heat roller is within a first predetermined temperature range, said temperature distribution controlling system comprising a fan and a controller which controls distribution of air, adjacent to said fan, to be distributed to predetermined portions of said heat roller so as to maintain the temperature differential between predetermined portions of said heat roller within said first predetermined temperature range; and a temperature level controlling system, which controls a reference temperature of said heat roller to be in a second predetermined range.

19. The temperature controlling device according to claim 18, said temperature distribution controlling system comprising a plurality of temperature sensors that detect areas of predetermined portions of said heat roller.

20. The temperature controlling device according to claim 18, said temperature distribution controlling system including at least one movable adjusting member extending between said fan and said heat roller, movement of said adjustable member increasing a flow of air to a first predetermined portion of said heat roller while simultaneously decreasing a flow of air to a second predetermined portion of said heat roller.

21. The temperature controlling device according to claim 18, said temperature distribution controlling system including an air blowing system, said air blowing system including at least one fan and a plurality of partition members defining a plurality of ducts extending from said at least one fan to said heat roller, two outermost partition members being fixed at predetermined positions, and at least an inner partition member of said plurality of partition members being movable to form a plurality of ducts of variable size.

* * * * *